US007147610B2

(12) United States Patent
Maalouf

(10) Patent No.: US 7,147,610 B2
(45) Date of Patent: Dec. 12, 2006

(54) MULTIPLE COMBINATION HEAT/MASSAGE DEVICES

(76) Inventor: Tarek Maalouf, 1300 Sam Houston Ave., Huntsville, TX (US) 77340

( * ) Notice: Subject to any disclaimer, the term of this patent is extended or adjusted under 35 U.S.C. 154(b) by 515 days.

(21) Appl. No.: 10/465,256

(22) Filed: Jun. 19, 2003

(65) Prior Publication Data

US 2004/0260211 A1 Dec. 23, 2004

(51) Int. Cl.
*A61H 1/00* (2006.01)
*A61H 23/00* (2006.01)

(52) U.S. Cl. ..... 601/15; 601/70; 601/79

(58) Field of Classification Search ..... 601/15, 601/70, 46, 48, 18, 56, 57, 71, 79
See application file for complete search history.

(56) References Cited

U.S. PATENT DOCUMENTS 2,329,766 A * 9/1943 Jacobsen ..... 219/211
3,886,934 A 6/1975 Doty
4,607,624 A 8/1986 Jefferson
5,429,585 A * 7/1995 Liang ..... 601/15
5,902,256 A 5/1999 Benaron
6,193,678 B1 2/2001 Brannon
6,329,638 B1 * 12/2001 Bloodworth ..... 219/211
2003/0060739 A1 * 3/2003 Connor et al. ..... 601/15
2004/0133133 A1 * 7/2004 Dreimann et al. ..... 601/15

* cited by examiner

*Primary Examiner*—Danton Demille
*Assistant Examiner*—Manuj Agarwal
(74) *Attorney, Agent, or Firm*—Egbert Law Offices

(57) ABSTRACT

A system of heat/massage devices for a user's body parts needing heat and massage therapy. Conformable pads, made from a flexible, water-resistant material such as neoprene, nylon, vinyl, or GORE-TEX®, hold vibration and heating elements, which are electrically connected to a control unit with variable control switches. Several of the pads can be used simultaneously, and each can be controlled individually. One pad can be connected to another pad in series to increase the number of pads that can be used at the same time.

14 Claims, 10 Drawing Sheets

MULTIPLE COMBINATION HEAT/MASSAGE DEVICES

FIELD OF THE INVENTION

The present invention relates to a plurality of individually-controlled, combination heat/massage devices comprising pads with heating and massaging elements, which can be wrapped around body parts needing heat and massage therapy.

BACKGROUND OF THE INVENTION

It is well known to use heating pads for treating muscle and joint pain. It is also known that massage therapy can relax and soothe individuals. Several prior art devices combine heating/cooling elements with massage units. For example, U.S. Pat. No. 3,886,934 to Doty discloses a rigid housing with gripping arms for receiving a body portion, with a heating pad lining the gripping arms and housing, and vibrator means carried within the housing. U.S. Pat. No. 4,607,624 to Jefferson shows a unitary box-shaped device which contains a heating element, a vibration unit, and controls. U.S. Pat. No. 5,902,256 to Benaron discloses a flexible housing with one or more pockets for holding heating or cooling gel packs, as well as power vibrators. U.S. Pat. No. 6,193,678 to Brannon discloses a vest unit with a hook-and-pile-covered interior surface to which can be attached vibration units and heating elements.

However, none of the prior art devices combines the features of the present invention, which provides a plurality of heat/massage devices, each of which can be wrapped and secured around a different area of the body to relieve pain, swelling, and discomfort to knees, elbows, shoulders, ankles, etc. Several of the devices can be used simultaneously. Each device has individual controls to allow adjustment of the intensity of vibration and heat applied to an affected body part.

SUMMARY OF THE INVENTION

The heat/massage devices of the present invention can be generally rectangular in shape, or can be custom-cut to fit around a particular body part. Each device has a flexible water-resistant pad holding the heating and vibration elements; an optional soft inner layer and a protective outer layer can be used with the device. A releasable complementary fastening system is used to secure each device around a particular area of the user's body.

Each device is electrically and mechanically connectable to a control unit, either directly or in series with another device. As a result, a user may treat several areas of his or her body simultaneously. For instance, a body builder could treat both of his biceps and forearms simultaneously. Indicator switches on the control unit allow the user to adjust the heat level and vibration intensity of the elements in each pad. The control unit is generally powered using standard household receptacles; an adapter can facilitate its use with a vehicle's D/C power source.

The heat/massage devices can be made in different sizes, depending on the size of the user and the area to be treated. The appearance of the pads can be enhanced by the use of various colors and decorative designs.

It is an object of the present invention to provide a plurality of heat/massage devices to relieve pain, swelling, and discomfort in the knees, ankles, shoulders, elbows, and back by applying heat and vibration directly to several affected areas simultaneously.

A further object of the present invention is to provide heat/massage devices with individually controlled heating and vibration elements.

Yet another object of the present invention is to provide heating/massage devices which can be wrapped and secured around different parts of the body.

Still another object of the present invention is to provide lightweight heating/massage devices which are portable, versatile, and easy and convenient to use.

A still further object of the present invention is to provide heating/massage devices which can be connected in series, then connected to a main control unit.

Other advantages of the present invention will be understood from the detailed description of the preferred embodiments and the figures disclosed.

DESCRIPTION OF PREFERRED EMBODIMENT

Figure 1:
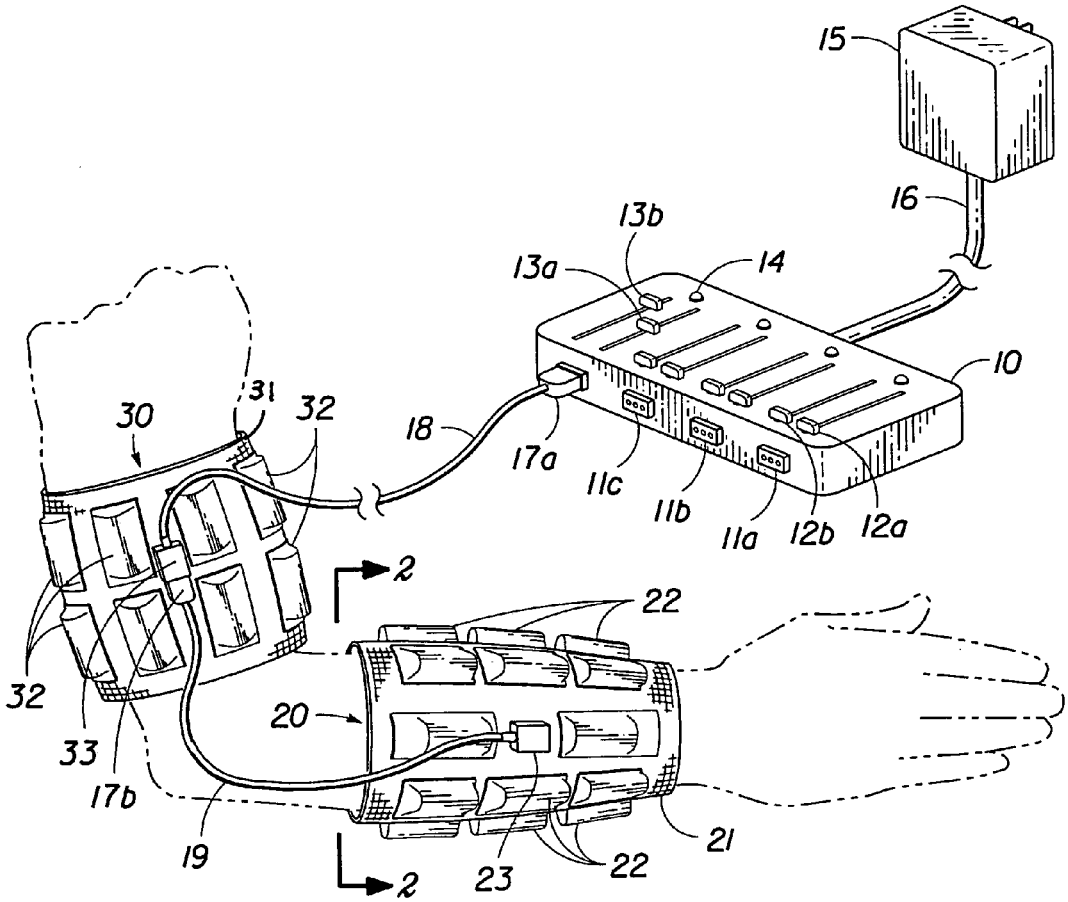
FIG. 1 is a perspective view of a forearm heat/massage device, connected to a bicep/tricep heat/massage device, which is plugged into a control unit.

As shown in FIG. 1, the invention uses a control unit 10 with multiple receptacles or jacks 11*a*, 11*b*, 11*c* (11*d*), each for receiving a connecting plug 17*a*. The control unit 10 has a variable position vibration control switch 12*a*, and a variable position heat control switch 12*b* for each connecting plug 17*a*. A user can move the variable position vibration control switch 13*a* and the variable position heat control switch 13*b* independently of each other, depending on the intensity of vibration and heat he desires. An indicator light 14 lets the user know that a particular heat/massage device, such as the forearm device 20 and/or the biceps/triceps device 30, is mechanically and electrically connected to the control unit 10. Although FIG. 1 shows four jacks 11*a*, 11*b*, 11*c*, (11*d*), a control unit 10 may have fewer or more jacks, or may have fewer jacks, with expansion slots for adding additional jacks, as needed. The control unit 10 is connected by power cord 16 to an AC to DC converter 15, which can be plugged into a household wall outlet. Alternatively, an adapter (not shown) can be provided to allow a user to operate the control unit 10 with another power generator, such as an automobile's DC power source.

As shown in FIG. 1, a generally rectangular forearm heat/massage device 20 has been wrapped around a user's forearm. The forearm device 20 has a support pad 21, made from flexible water-resistant material, such NEOPRENE™ nylon, vinyl or GORE-TEX®, which encases standard, readily available vibration elements 22 and heating elements (not shown). The vibration elements 22 and the heating elements (not shown) are connected by wiring (not shown) to junction box 23. As shown in FIG. 1, the forearm device 20 can be connected by electrical cable 19 to biceps/triceps device 30 by plugging connecting plug 17*b* into junction 33, which is connected by electrical cable 18 to the control unit 10 by plugging connector plug 17*a* into the control unit 10. Alternatively, forearm device 20 can be connected directly to the control unit 10 by plugging connector plug 17*b* into jack 11*c* on the control unit 10.

The generally rectangular biceps/triceps device 30 has been wrapped around the user's upper arm. The biceps/triceps device 30 has a support pad 31, made from NOEOPRENE™, nylon, vinyl, GORE-TEX®, or a similar water-resistant material, which encases standard, readily available vibration elements 32 and hearing elements (not shown). The vibration elements 32 and the heating elements (not shown) are connected by wiring (not shown) to junctions box 33. The biceps/triceps device 30 is connected by electrical cable 18 to the control unit 10 by plugging connector plug 7*a* into the control unit 10. As noted supra, additional heat/massage devices can be plugged into jacks 11*a*, 11*b*, and 11*c*, thereby allowing a user to treat other parts of his body, including joints, which may need heat/massage therapy.

Figure 2:
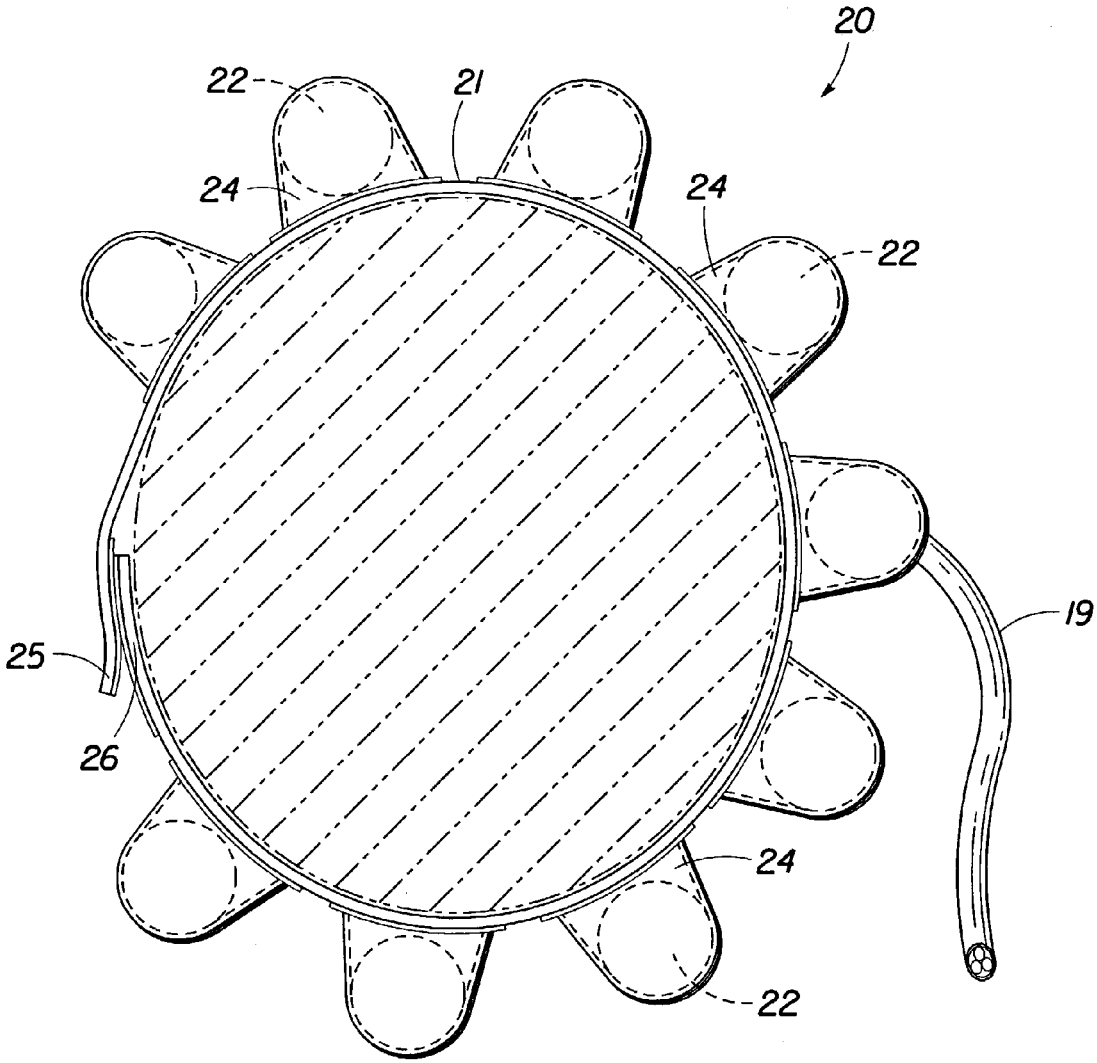
FIG. 2 is a cross-sectional view through an arm with a forearm device encircling it.

As shown in FIG. 2, the forearm heat/massage device 20 has been wrapped around a user's forearm, with an electrical cable 19 extending therefrom. The support pad 21 has multiple "pockets" 24, each of which encloses a vibration element 22. The support pad 21 is held in place on the arm by use of a repositionable fastening system. For example, as FIG. 2 shows, complementary strips of a hook and loop fastening system (VELCRO®) have been attached to ends of the support pad 21, and the first end of the support pad 21 with the first part 25 of the fastening system has been overlapped and secured to the second end of the support pad 21 with the complementary second part 26 of the fastening system.

Optionally, and not shown, the support pad 21 can have attached thereto an inner layer of soft cotton, to provide comfort to the skin, and/or an outer protective layer which can be removed for laundering. The outer layer can be made with decorative designs and colors, depending on the user's preferences.

Figure 3:
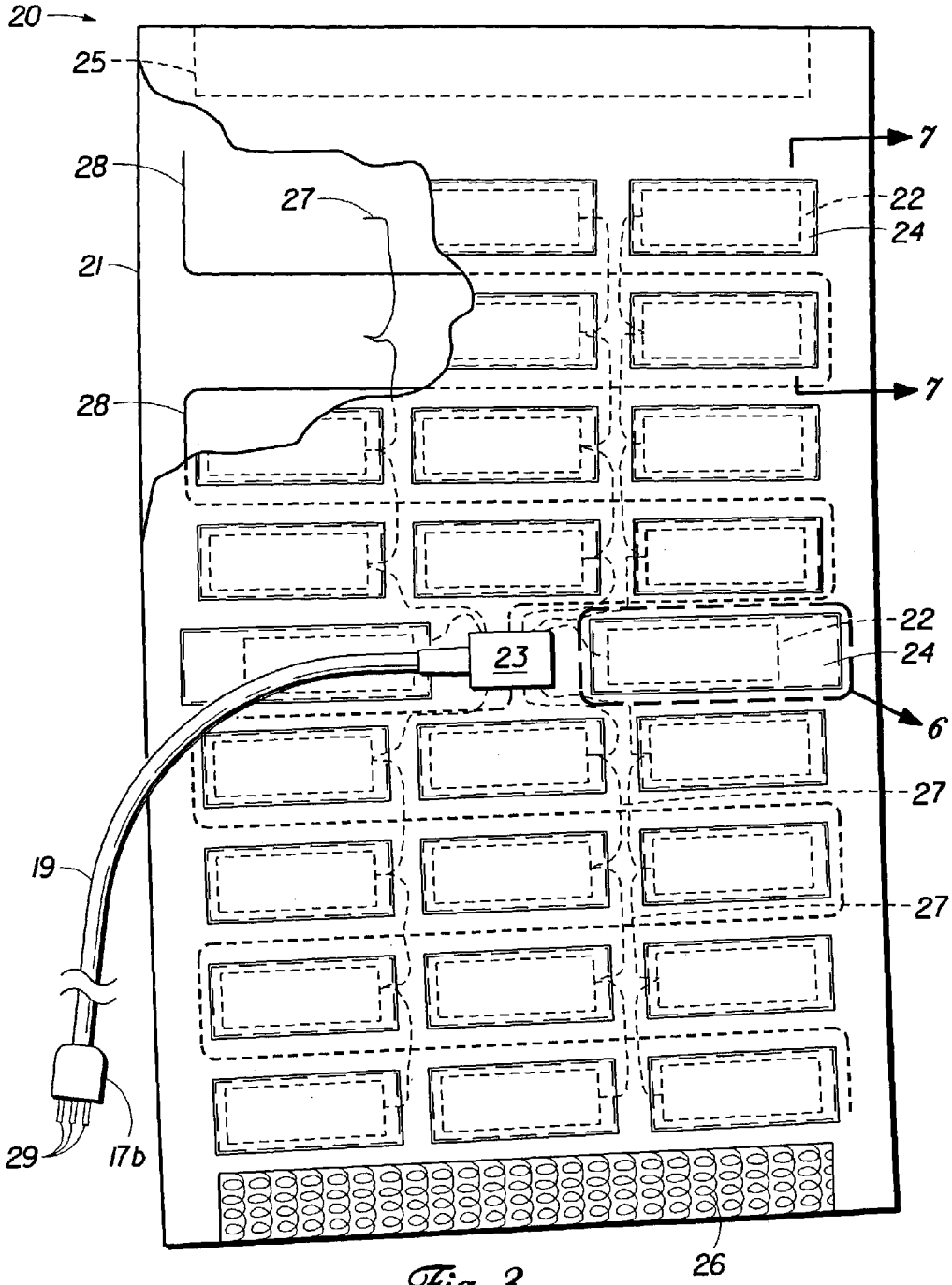
FIG. 3 is a top view of a forearm device, opened and laid flat.

The forearm heat/massage device 20 is shown opened and laid flat. The support pad 21 encloses vibration elements 22, each of which is held in a "pocket" 24. The vibration elements 22 are electrically connected to the junction box 23 by conventional wiring 27. The support pad also encloses heating elements 28, which are electrically connected to the junction box 23 by conventional wiring 27. Power to the device is carried by electrical cable 19, which has connector plug 17*b* with prongs 29. The first end of the support pad 21 has the first part 25 of a fastening system, and the second end of the support pad 21 has the complementary second part 26 of the fastening system. Although FIG. 3 shows twenty-six vibration elements 22, more or fewer vibration elements 22 may be used, depending on design choice.

Figure 4:
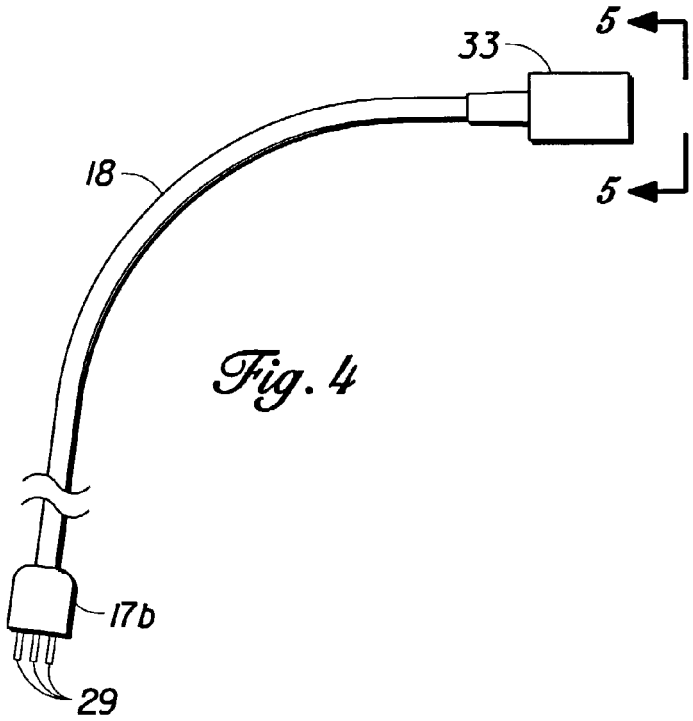
FIG. 4 is a front view of a cable used to attach a heat/massage device to a control unit.

As shown in FIG. 4, the electrical cable 18 used with a heat/massage device has a connector plug 17*b* with prongs 29 and a junction box 33.

Figure 5:
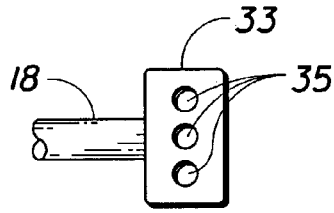
FIG. 5 is an end view of an end of the cable.

As shown in FIG. 5, the electrical cable 18 used with a heat/massage device has a junction box 33 with openings 35 for receiving the prongs 29 of connector plug 17*b*.

Figure 6:
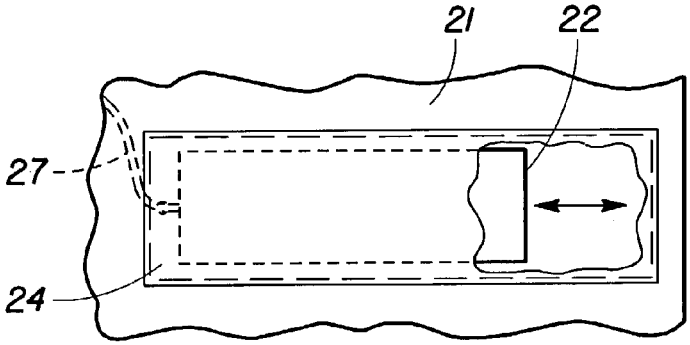
FIG. 6 is a detail view of one of the vibrator elements inside a holding pocket on a heat/massage device.

As shown in FIG. 6, each "pocket" 24 on a support pad 21 holds a vibration element 22, with space for movement of the vibration element 22 due to its vibration. Optionally, additional space can be provided to allow manual sideways movement of each vibration element within the "pocket" 24 to allow a user to adjust the position of each vibration element, depending on his preference. Wiring 27 provides power to the vibration element 22.

Figure 7:
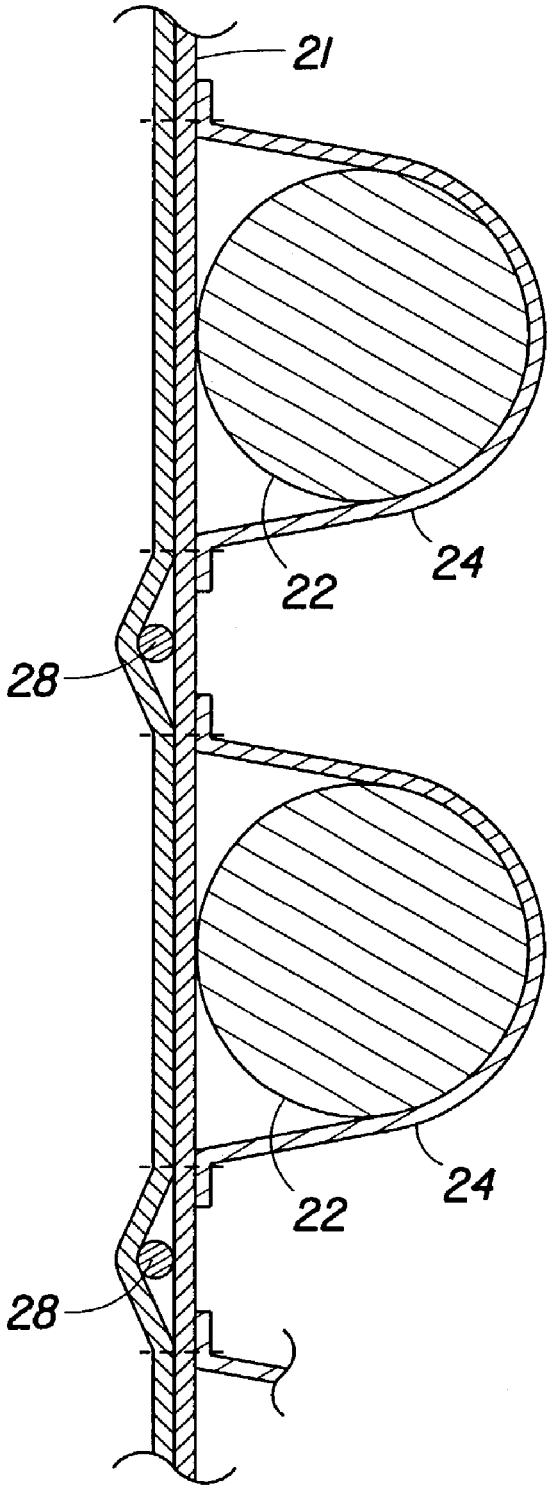
FIG. 7 is a cross-sectional side view of part of a heat/massage device showing the vibration elements and the heating elements.

FIG. 7 shows a cross-sectional view of vibration element 22 held in "pocket" 24 on the support pad 21. Heating elements 28 carry heat throughout the support pad 21.

FIGS. 8 through 14 show different embodiments of the heat/massage device of the present invention. As shown, the heat/massage devices can be configured to fit particular areas of the body in need of heat/massage therapy.

Figure 8:
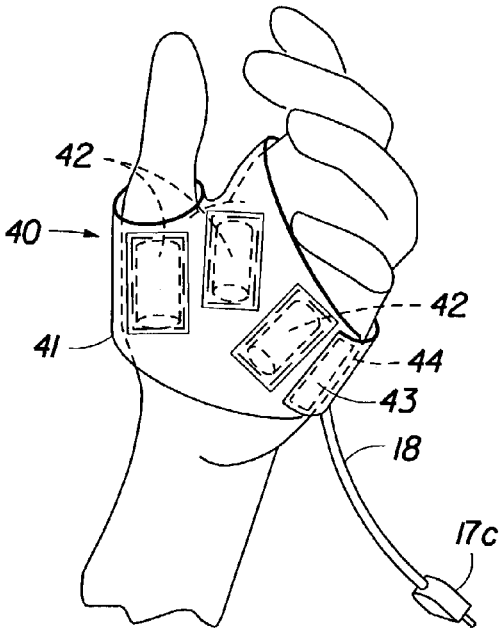
FIG. 8 is a front view of a hand heat/massage device, ready for use.

In FIG. 8, a hand heat/massage device 40 has an opening for a thumb. The support pad 41 holding the vibration elements 42 and the heating elements (not shown) is wrapped around the palm, and the first end of the support pad 41 with the first part 43 of the fastening system has been overlapped and secured to the second end of the support pad 41 with complementary second part 44 of the fastening system. Electrical cable 18 with connector plug 17*c* carries power to the hand heat/massage device 40 from the control unit 10 (not shown).

Figure 9:
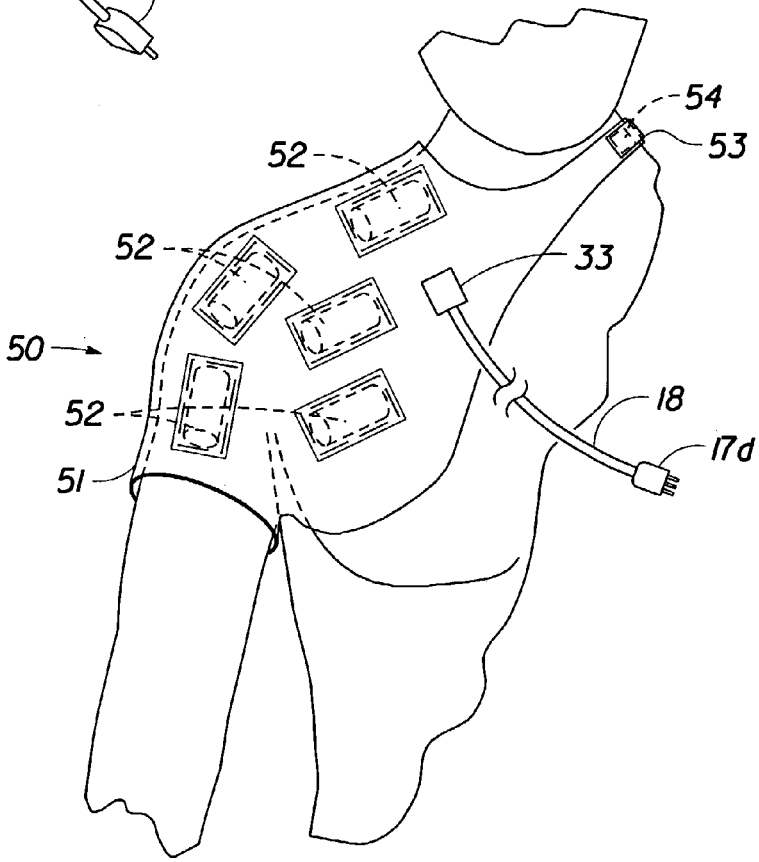
FIG. 9 is a front view of a shoulder heat/massage device, ready use.

In FIG. 9, a shoulder heat/massage device 50 has an opening for a user's arm. The support pad 51 holding the vibration elements 52 and the heating elements (not shown) is wrapped around a user's shoulder and the first end of the support pad 51 with the first part 53 of the fastening system has been overlapped and secured to the second end of the support pad 51 with the complementary second part 54 of the fastening system. Electrical cable 18 with connector plug 17*d* carries power to the shoulder heat/massage device 50 through junction box 33.

Figure 10:
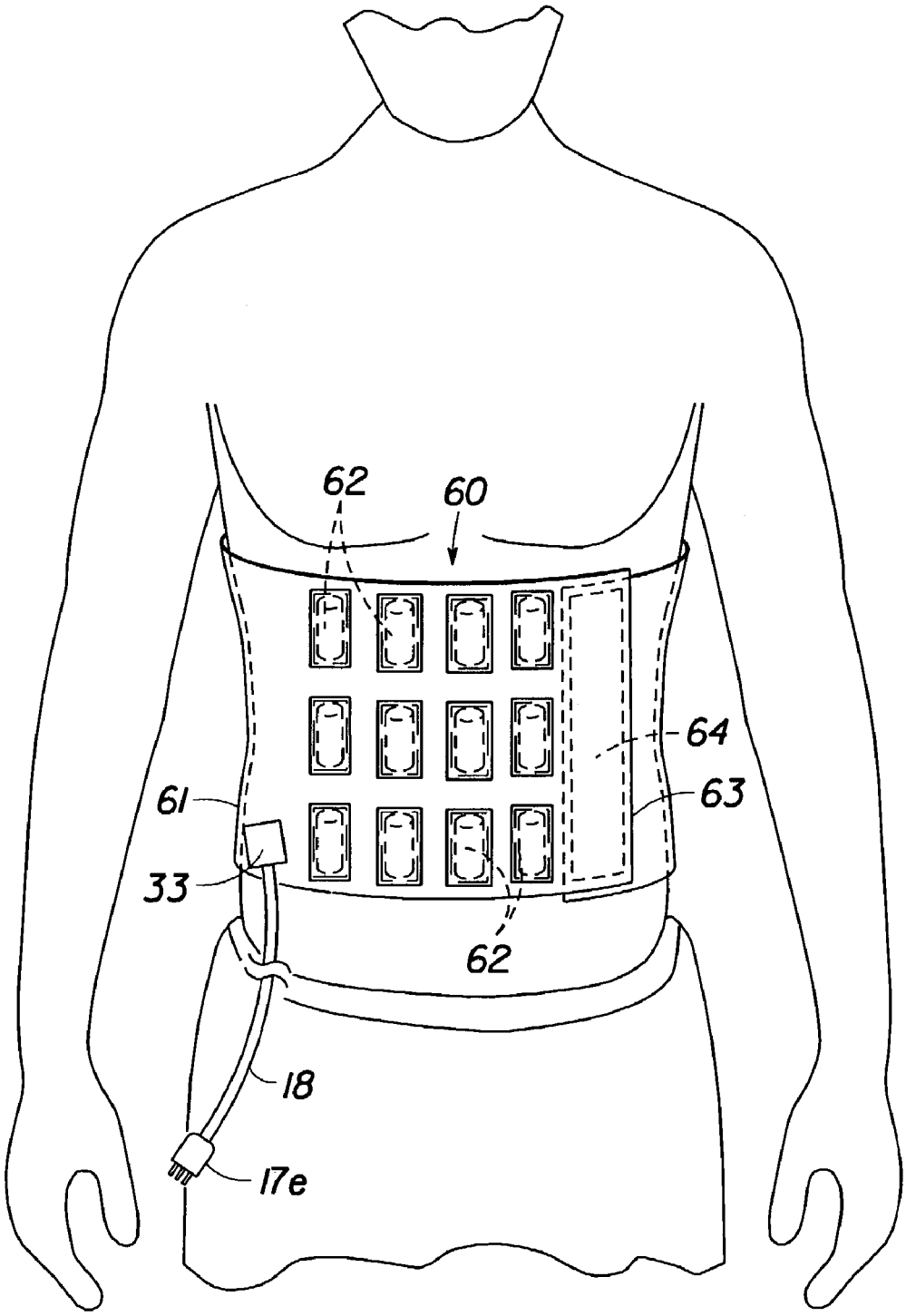
FIG. 10 is a front view of a torso heat/massage device, ready for use.

In FIG. 10, a torso heat/massage device 60 has been wrapped around a user's torso. The support pad holds vibration elements 62 and heating elements (not shown), which can be positioned to provide vibration and heat to affected areas. The first end of the support pad 61 with the first part 63 of the fastening system has been overlapped and secured to the second end of the support pad 61 with the complementary second part 64 of the fastening system. Electrical cable 18 with connector plug 17*e* carries power to the torso heat/massage device 60 through junction box 33.

Figure 11:
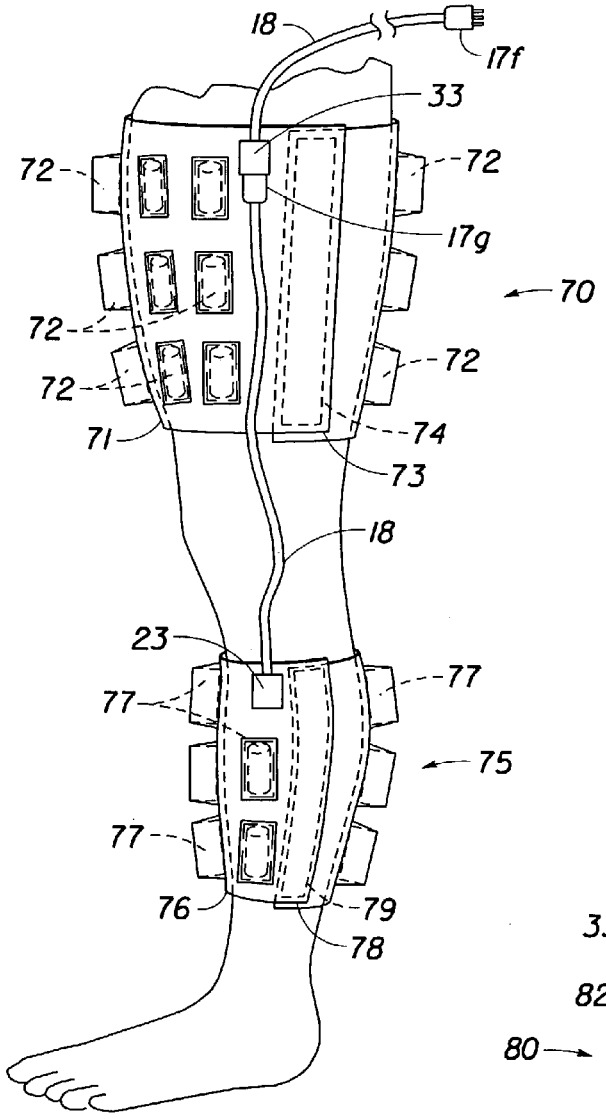
FIG. 11 is a front view of a thigh and a calf heat/massage device, ready for in use.

In FIG. 11, a user is using a thigh heat/massage device 70 and a calf heat/massage device 75 simultaneously. The support pad 71 holding the vibration elements 72 and heating elements (not shown) is wrapped around the user's thigh, and the first end of the support pad 71 with the first part 73 of the fastening system has been overlapped and secured to the second end of the support pad 71 with the complementary second part 74 of the fastening system. Electrical cable 18 with connector plug 17*f* carries power from the control unit 10 (not shown) to the thigh heat/massage device 70 though junction box 33.

A calf heat/massage device 75 can be used alone or in connection with the thigh heat/massage device 70. The support pad 76 holding the vibration elements 77 and the heating elements (not shown) is wrapped around the user's calf, and the first end of the support pad 76 with the first part 78 of the fastening system has been overlapped and secured to the second end of the support pad 76 with the complementary second part 79 of the fastening system. Electrical cable 19 with connector plug 17*g* carries electrical power from junction box 33 to junction box 23.

Figure 12:
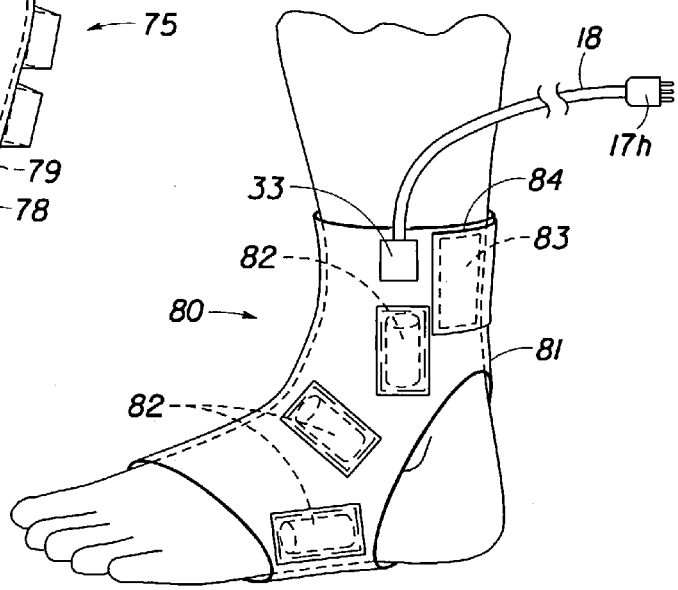
FIG. 12 is a front view of an ankle heat/massage device, ready use.

In FIG. 12, a foot heat/massage device 80 has an opening for a user's foot. The support pad 81 holding the vibration elements 82 and the heating elements (not shown) is wrapped around the user's ankle, and the first end of the support pad 81 with the first part 83 of the fastening system has been overlapped and secured to the second end of the support pad 81 with the complementary second part 84 of the fastening system. Electrical cable 18 with connector plug 17*h* carries power to the junction box 33 from the control unit 10 (not shown).

Figure 13:
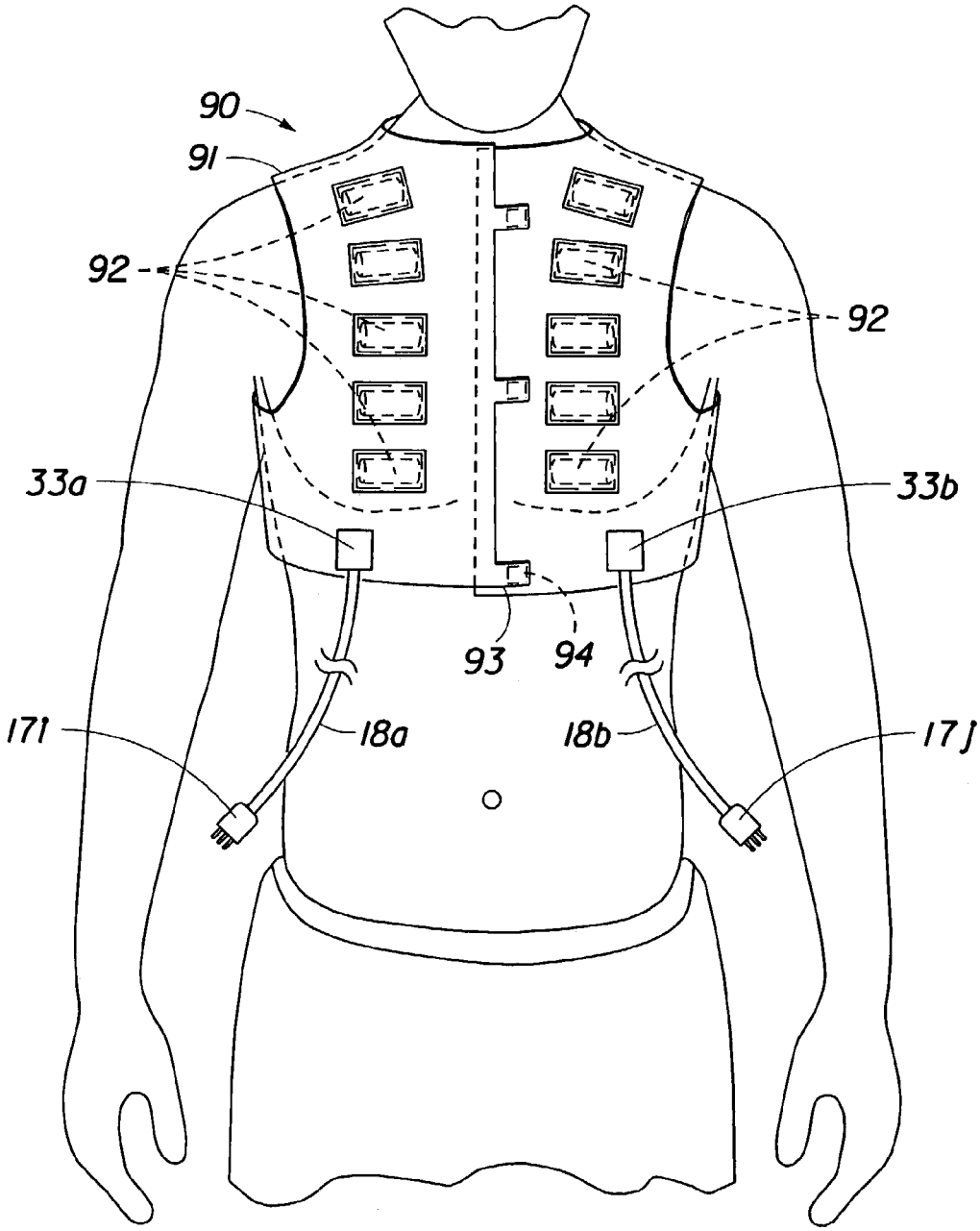
FIG. 13 is a front view of a combination chest/back heat/massage device, ready for use.

In FIG. 13, a vestlike chest/back heat/massage device 90 has openings for a user's arms. The support pad 91 holding the vibration elements 92 and the heating elements (not shown) is worn like a jacket, and the first end of the support pad 91 with the first part 93 of the fastening system has been overlapped and secured to the second end of the support pad 91 with the complementary second part 94 of the fastening system. Electrical cable 18*a* with connector plug 17*i* carries power to the chest vibration elements 92 from the control unit 10 (not shown). Electrical cable 18*b* carries power to the back vibration elements 95 (not shown) from the control unit 10 (not shown). Alternatively, connector plug 17*i* can be plugged into junction box 33*b*, or connector plug 17*j* can be plugged into junction box 33*a*, and both will be operated simultaneously (as shown in FIG. 1 and FIG. 11).

Figure 14:
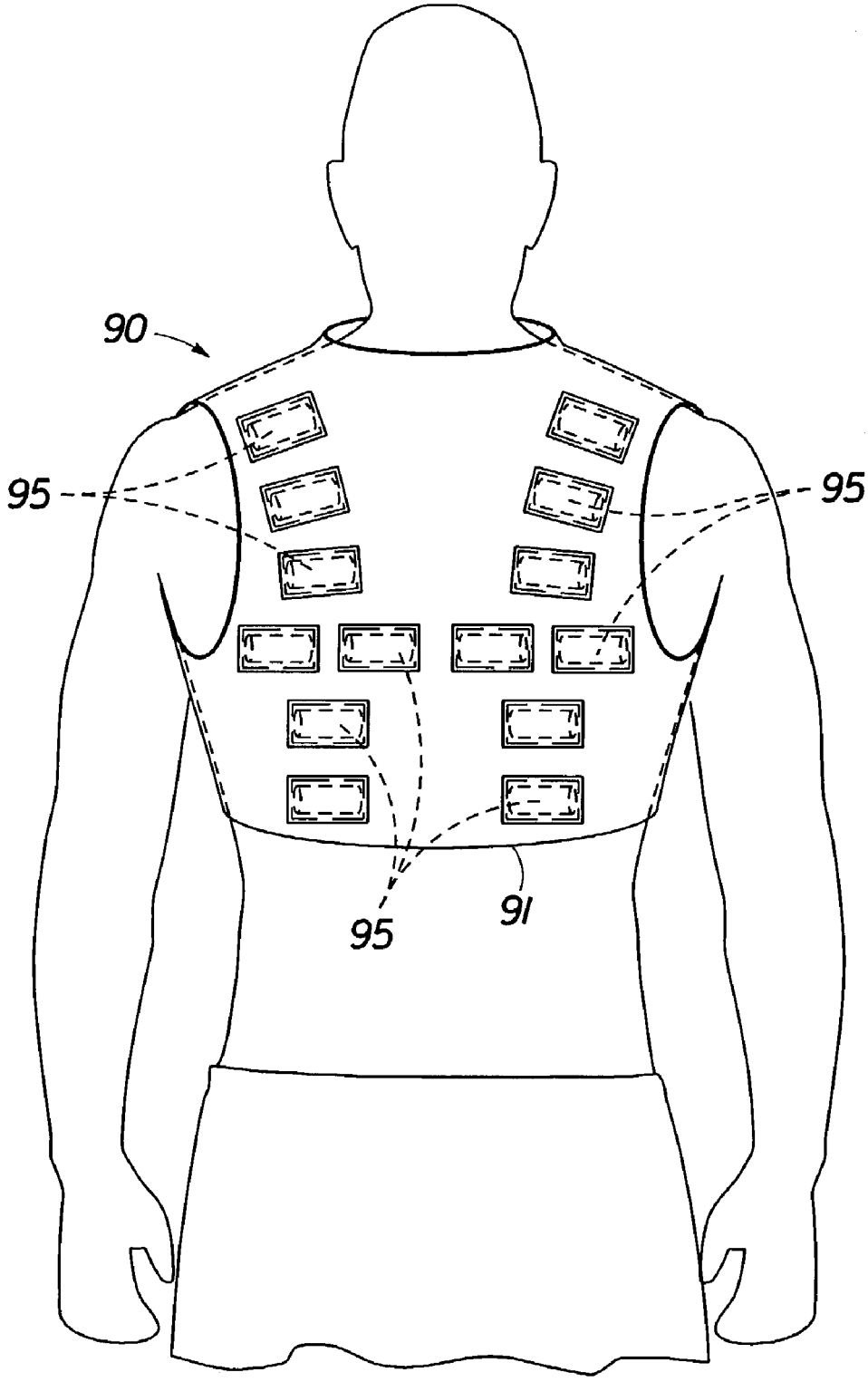
FIG. 14 is a back view of the chest/back device of FIG. 13.

As shown in FIG. 14, the chest/back heat/massage device 90 has back vibration elements 95 held by the support pad 91.

I claim:

1. A heat/massage system for physical therapy comprising:

a control unit connected to a power source, the control unit having a plurality of receptacles, each of the receptacles having an associated variable position vibration control switch and a variable position heat control switch;

a first flexible heat/massage pad conformable to a first part of a user's body, the first pad holding a plurality of vibration elements, the vibration elements being electrically connected to a first junction box on the first pad, the first pad further having a two-part releasable fastening system so that the first pad can be wrapped around the first part of the user's body and secured thereto;

means for electrically connecting the first junction box on the first pad to one of the receptacles on the control unit;

a first flexible massage pad conformable to a second part of the user's body, the first flexible massage pad holding a plurality of vibration elements, the vibration elements being electrically connected to a second junction box on the first flexible massage pad, the second pad further having attached thereto a two-part releasable fastening system so that the first flexible massage pad can be wrapped around the second part of the user's body and secured thereto; and means for electrically connecting the second junction box on the first flexible massage pad to one of the receptacles on the control unit.

2. The heat/massage system of claim 1, wherein the first flexible heat/massage pad is essentially rectangular in shape and wherein the first body part of the user's body is selected from the group consisting of a forearm, biceps/triceps area, calf, thigh, and torso.

3. The heat/massage system of claim 1, wherein a first flexible massage pad is formed with an opening and whereas the second body part of the user's body is selected from the group consisting of a foot, hand, and shoulder.

4. The heat/massage system of claim 1, further comprising:

a second flexible massage pad conformable to a third part of the user's body, the second pad holding a plurality of vibration elements, the vibration elements being electrically connected to a third junction box on the second pad, the second pad further having attached thereto a two-part releasable fastening system so that the second pad can be wrapped around the third part of the user's body and secured thereto;

means for electrically connecting the third junction box on the second pad to one of the receptacles on the control unit.

5. The heat/massage system of claim 4, further comprising:

a third flexible massage pad conformable to a fourth part of a user's body, the third flexible massage pad holding a plurality of vibration elements, vibration elements being electrically connected to a fourth junction box on the third flexible massage pad, the fourth pad further having a two-part releasable fastening system so that the the third flexible massage pad can be wrapped around body and secured thereto; and means for electrically connecting the fourth junction box on the fourth pad to one of the receptacles the control unit.

6. The heat/massage system of claim 1, wherein the first flexible heat/massage pad and first flexible massage pad are made from a material selected from the group consisting of a polychloroprene-based synthetic rubber, nylon, vinyl and waterproof/breathable fabric.

7. A heat/massage system for physical therapy comprising:

a control unit connected to a power source, the control unit having a plurality of receptacles, each of the receptacles having an associated variable position vibration control switch and a variable position heat control switch;

a first flexible heat/massage pad conformable to a first part of a user's body, the first pad holding a plurality of vibration elements and heating elements, the vibration elements and heating elements being electrically connected to a first junction box on the first pad, the first pad further having a two-part releasable fastening system so that the first pad can be wrapped around the first part of the user's body and secured thereto;

means for electrically connecting the first junction box on the first pad to one of the receptacles on the control unit;

a first flexible massage pad conformable to a second part of the user's body, the first flexible massage pad holding a plurality of vibration elements the vibration elements being electrically connected to a second junction box on the first flexible massage pad, the second pad further having attached thereto a two-part releasable fastening system so that the first flexible massage pad can be wrapped around the second part of the user's body and secured thereto; and means for electrically connecting the second junction box on the first flexible massage pad to the first junction box on the first pad.

8. The heat/massage system of claim 7, wherein the first flexible heat/massage pad is essentially rectangular in shape, and wherein the first body part of the user's body is selected from the group consisting of a forearm, biceps/triceps area, calf, thigh, and torso.

9. The heat/massage system of claim 7, wherein a first flexible massage pad is formed with an opening and wherein the second body part of the user's body is selected from the group consisting of a foot, hand, and shoulder.

10. The heat/massage system of claim 7, wherein the heat/massage pad and massage pad are made from a material selected from the group consisting of a polychioroprene-based synthetic rubber, nylon, vinyl, and a waterproof/breathable fabric.

11. A massage system for physical therapy comprising:

a control unit connected to a power source, the control unit having a plurality of receptacles, each of the receptacles having an associated variable position vibration control switch and a variable position heat control switch;

a flexible massage vest having a front side with an opening and a back side;

a first set of a plurality of vibration elements held within the front side of the vest, the first set of vibration elements being electrically connected to a first junction box on the vest;

a second set of a plurality of vibration elements held within the back side of the vest, the second set of vibration elements being electrically connected to a second junction box on the vest; and means for electrically connecting the first junction box and the second junction box to the receptacles on the control unit.

12. The massage vest system of claim 11, wherein the opening in the first side of the vest can be closed with a two-part releasable fastening system attached to the first side of the vest.

13. The massage vest system of claim 11, wherein the massage vest is made from a material selected from the group consisting of polychloroprene-based synthetic rubber, nylon, vinyl, and a waterproof/breathable fabric.

14. The massage vest system of claim 11, further comprising:

means for electrically connecting the first junction box to the second junction box.

* * * * *